US007384190B2

(12) United States Patent
Zimmermann

(10) Patent No.: US 7,384,190 B2
(45) Date of Patent: Jun. 10, 2008

(54) CROWN FOR TIMEPIECE WITH DISCONNECTING GEAR DEVICE

(75) Inventor: Georges Zimmermann, Küttigkofen (CH)

(73) Assignee: Meco SA, Grenchen (CH)

( * ) Notice: Subject to any disclaimer, the term of this patent is extended or adjusted under 35 U.S.C. 154(b) by 50 days.

(21) Appl. No.: 10/599,978

(22) PCT Filed: Apr. 5, 2005

(86) PCT No.: PCT/EP2005/003556

§ 371 (c)(1),
(2), (4) Date: Oct. 16, 2006

(87) PCT Pub. No.: WO2005/111741

PCT Pub. Date: Nov. 24, 2005

(65) Prior Publication Data

US 2008/0008053 A1 Jan. 10, 2008

(30) Foreign Application Priority Data

Apr. 14, 2004 (EP) ..... 04101530

(51) Int. Cl.
*G04B 29/00* (2006.01)
*G04B 37/00* (2006.01)

(52) U.S. Cl. ..... 368/308; 368/319

(58) Field of Classification Search ..... 368/288–290, 368/306–308

See application file for complete search history.

(56) References Cited

U.S. PATENT DOCUMENTS 680,067 A 8/1901 Phillips
2,563,112 A 8/1951 Hill et al.
2,637,987 A 5/1953 Hill et al.
2,716,875 A 9/1955 Hill et al.
3,686,883 A * 8/1972 Tarusawa ..... 368/289

(Continued)

FOREIGN PATENT DOCUMENTS

FR 932221 3/1948

(Continued)

OTHER PUBLICATIONS

International Search Report issued in corresponding application No. PCT/EP2005/003556, completed Jun. 24, 2005 and mailed Jun. 30, 2005.

*Primary Examiner*—Vit W Miska
(74) *Attorney, Agent, or Firm*—Griffin & Szipl, P.C.

(57) ABSTRACT

The present invention concerns a crown for a timepiece comprising a disconnecting gear device for preventing damage to the components of the movement of the timepiece in which it is implemented. For this purpose, the crown is provided with a housing which houses a pipe, to which one end of a winding stem is connected, carrying at least one spring and a rigid ring secured to the crown and comprising notches adapted to cooperate with the spring. In common use, a rotation of the crown causes a rotation of the pipe and thus of the winding stem, via the rigid ring and the spring. Owing to the device according to the present invention, when the mechanical resistance to the rotation opposed by the winding stem, via the pipe, exceeds a predefined threshold, the spring is deformed and is no longer driven in rotation by the rigid ring. Consequently, the winding stem is no longer driven in rotation in such conditions.

16 Claims, 3 Drawing Sheets

U.S. PATENT DOCUMENTS

| | | | | | |
|---|---|---|---|---|---|
| 3,994,125 | A * | 11/1976 | Wenger | 368/290 |
| 4,089,158 | A * | 5/1978 | Wenger | 368/216 |
| 7,192,184 | B2 * | 3/2007 | Hiranuma et al. | 368/319 |
| 2007/0025190 | A1 * | 2/2007 | Cretin | 368/319 |

FOREIGN PATENT DOCUMENTS

| | | |
|---|---|---|
| GB | 604034 | 8/1948 |

* cited by examiner

CROWN FOR TIMEPIECE WITH DISCONNECTING GEAR DEVICE

This is a National Phase Application in the United States of International Patent Application No. PCT/EP2005/003556 filed Apr. 5, 2005, which claims priority on European Patent Application No. 04101530.6, filed Apr. 14, 2004. The entire disclosures of the above patent applications are hereby incorporated by reference.

FIELD OF THE INVENTION

The present invention concerns a crown for a timepiece comprising a housing of axis X1 inside which is arranged a pipe including, in the region of a first end, means for securing a winding stem. The housing also includes at least a first element, able to be deformed in a resilient manner, cooperating via friction in a movement of rotation in relation to axis X1, at least in a first direction of rotation, with one rigid element of suitable shape, as long as the rotational couple transmitted by one of these elements to the other remains lower than a predefined value. Beyond the predefined value, the first deformable element is capable of being deformed to cause a sliding connection between said element and the rigid element.

BACKGROUND OF THE INVENTION

These types of crowns comprising a disconnecting gear device are known in the prior art. Such devices are known to be implemented, for example, to prevent damaging the mechanism of a timepiece when the winding stem is driven by the user to wind the barrel spring, when the latter is completely wound.

U.S. Pat. No. 2,637,987 discloses several embodiments of a crown of the aforementioned type. In all of the embodiments disclosed, the crown comprises a cylindrical housing inside which the disconnecting gear device is arranged. In particular, the housing comprises, at the periphery thereof, a strip spring secured to the crown, for cooperating with one end of the winding stem arranged inside the housing. For this purpose, the end of the winding stem has a particular shape, peculiar to each of the embodiments disclosed, fitted to the shape of the corresponding strip spring.

The cooperation between the strip spring and the winding stem is effective as long as the rotational couple to be transmitted to the winding stem from a rotation of the crown, via the strip spring, does not exceed a predefined value. When this predefined value is attained, which may be the case for example when the barrel spring is completely wound, the strip spring is deformed and stops cooperating with the winding stem. Thus, any subsequent rotational movement of the crown in these conditions is no longer transmitted to the winding stem.

The device disclosed in this American Patent has, however, a certain number of drawbacks. In fact, the structure disclosed and shown is complex both from the manufacturing and assembly point of view, in particular because of the dimensions to be considered within the field of crowns for horology. Manufacturing the various springs implemented is difficult, on the one hand because of their shape, and on the other hand, because they are mounted pre-stressed, which makes it difficult to mount them in the crown.

Another drawback of the device disclosed in U.S. Pat. No. 2,637,987 arises from the necessity of providing a particular shape for the end of the winding stem arranged inside the crown, such that it can cooperate with the particular shape used for the spring. This constraint forces the manufacturer to provide different manufacturing processes for the different winding stem shapes to be used, thereby causing extra costs.

SUMMARY OF THE INVENTION

It is therefore a main object of the present invention to overcome the aforementioned drawbacks of the prior art by providing a device for a crown, preventing damage being caused to a timepiece movement, said device having a simple structure and being easy to assembly compared to devices of the prior art.

The present invention therefore concerns a crown of the aforementioned type, characterized in that the element able to be resiliently deformed is secured to the pipe whereas the rigid element is secured to the crown.

Owing to these features, the device according to the invention has a relatively simple structure obtained by equally simple assembly. Moreover, the fact that the resilient element is arranged on the pipe receiving the winding stem does not impose any particular structure for the end of the winding stem disposed in the crown, on the manufacturer. Such a characteristic allows the manufacturer to limit itself to only one structure of winding stem, whatever variant of the present invention is implemented.

In a preferred embodiment of the present invention, the deformable element is made in the form of a spring comprising a central base from which at least two, preferably four, deformable arms extend. In this case, the rigid element is made in the form of a ring comprising a plurality of notches arranged on its inner periphery for cooperating with surface areas of the deformable arms.

Owing to this structure, the deformable element can be mounted in the housing of the crown without being pre-stressed, which greatly simplifies assembly compared to the aforementioned device of the prior art.

In a preferred but non-limiting manner, cooperation between the spring and the ring is permanent in a first direction of rotation, i.e. it does not depend upon the value of the couple transmitted by one of the elements to the other, whereas a disconnecting gear threshold is provided in the second direction of rotation.

Alternatively, two stages are provided, each of which includes a spring and notched ring assembly, each of the two stages allowing the device to be disconnected in a predefined direction. In this case, the crown is capable of being moved along its axis X1 in relation to the winding stem in order to start one stage or the other.

Preferably, the deformable element and the rigid element are respectively made of metals whose respective hardnesses are close, this feature guaranteeing proper longevity for the device according to the present invention.

BRIEF DESCRIPTION OF THE DRAWINGS

Other features and advantages of the present invention will appear more clearly upon reading the following detailed description, made with reference to the annexed drawings, given by way of non-limiting examples and in which.

DETAILED DESCRIPTION OF THE INVENTION

Figure 1:
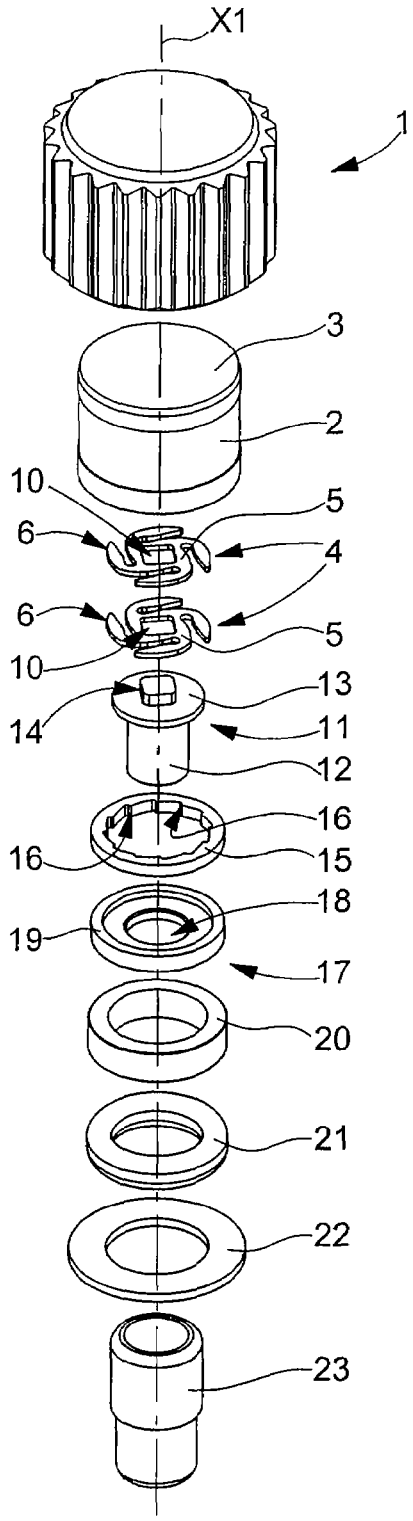
FIG. 1 shows an exploded perspective view of the crown for a timepiece according to a preferred embodiment of the present invention.

FIG. 1 shows an exploded perspective view of the crown according to a preferred embodiment of the present invention demonstrating the simplicity of the corresponding structure and the simplicity of assembly of the various components with each other.

The various constituent elements of the crown according to the invention are shown in an order schematising the assembly sequences thereof in FIG. 1.

The numerical reference 1 designates the crown itself, the latter having rotational symmetry of axis X1 and being hollow so as to define a housing (visible in FIG. 2) for housing the following components. A hollow support element 2 whose dimensions are adjusted to the dimensions of the crown housing has the shape of a cylinder, closed on one side by way of illustration, by a bottom 3. There are then two identical springs 4 to be arranged in proximity to the bottom 3 of support element 2. Two identical springs 4 are provided here because of the thickness of the material necessary to obtain the desired rigidity, for the sake of simplifying the method of machining these springs.

Each of springs 4 is of the flat spring type, comprising a central base 5, whose shape is generally close to that of a square, from which extend four arms 6 that can be resiliently deformed. Each of arms 6 comprises two successive portions, a first short portion 7 extending from the central base 5 along a substantially radial direction prior to exhibiting an elbow 8, substantially at right angles, extended by a second, substantially rectilinear, portion 9. It will also be observed that central base 5 of each of springs 4 has a hole 10 centred in relation to axis X1 and of substantially square shape in the example shown. The operation of springs 4 will be explained in more detail in relation to FIG. 3.

Next, in FIG. 1, there is a pipe 11 for receiving one end of a winding stem (not shown). Pipe 11 has a main part 12 of cylindrical shape, on which a head 13 is mounted, in the shape of a disc of larger diameter than the main part. A portion 14 of smaller transverse dimensions that the head is mounted on head 13, projecting in relation to the latter and centred on axis X1. The projecting portion 14 has a contour of complementary shape, substantially square here, to that of holes 10 of the springs and for cooperating therewith. Any other non-circular shape can be provided for aperture 10 and projecting portion 14, such as, for example, polygonal, without departing from the scope of the present invention provided that it is possible for projecting portion 14 to be driven in rotation by springs 4 by cooperating therewith. Thus, as is seen more clearly in FIG. 2, the height of projecting portion 14 is greater than the thickness of the two springs 14 joined together.

There is then provided a rigid element 15, in the shape of a ring or washer, whose central aperture has a larger diameter than the diameter of head 13 of the pipe and a periphery with notches 13. Ring 15 is to be positioned in proximity to the bottom 3 of the support element such that notches 16 are located opposite arms 6 of springs 4, as is seen more clearly in FIG. 3.

There is then an additional washer 17 to carry ring 15 and pipe 11. For this purpose, washer 17 has an external diameter substantially equal to the diameter of ring 15 and a central aperture 18 of smaller diameter than the diameter of head 13 of the pipe. Washer 17 further includes an annular shoulder 19 whose inner diameter is substantially greater than the diameter of head 13 of the pipe and whose external diameter is substantially equal to the diameter of ring 15. Washer 17 is made such that the thickness of its annular shoulder 19 is equal to or greater than the thickness of head 13 of the pipe, the shoulder thus performing the function of a spacer.

The remaining components are elements for closing the device to ensure that it is sealed without making any other contribution to the disconnecting gear device according to the present invention.

For this purpose, a reducing washer 20 is used whose external diameter is substantially less than the inner diameter of the support element 2 and against which there is arranged an O-ring joint 21 whose diameter at rest is substantially greater than the inner diameter of support element 2. A flat washer 22 is then provided for closing the housing of crown 1.

A tube 23, or socket, is arranged through the aperture centrals of flat washer 22, annular gasket 21 and reducing washer 20, the main function of tube 23 being to connect crown 1 to the entry of the case (not shown) of the timepiece implementing the device according to the present invention, more specifically to the middle part. Tube 23 also has an external diameter substantially greater than the inner diameter of annular gasket 21 at rest.

Figure 2:
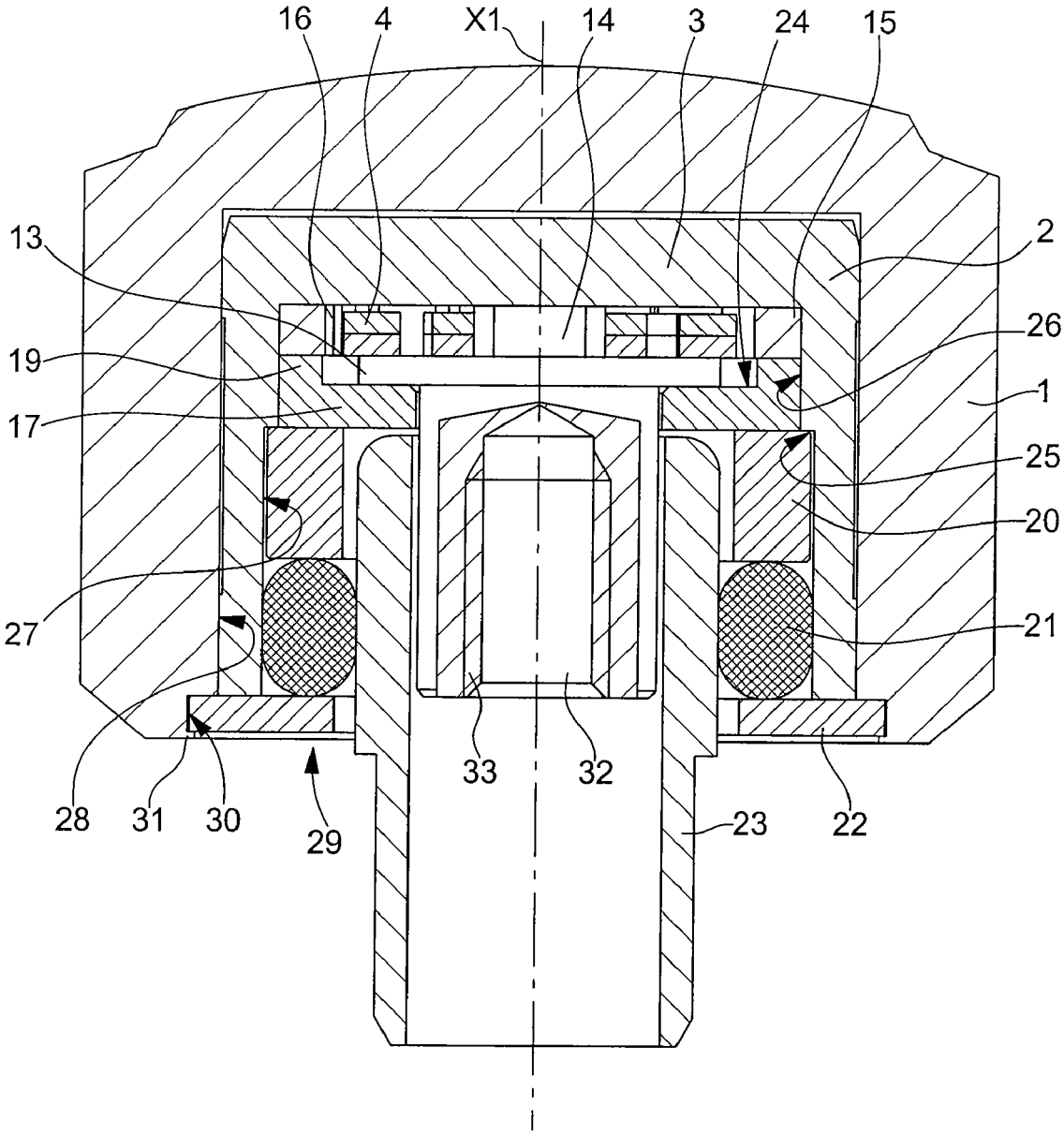
FIG. 2 shows a transverse cross-section of the crown shown in FIG. 1 when these components are assembled.
Figure 3:
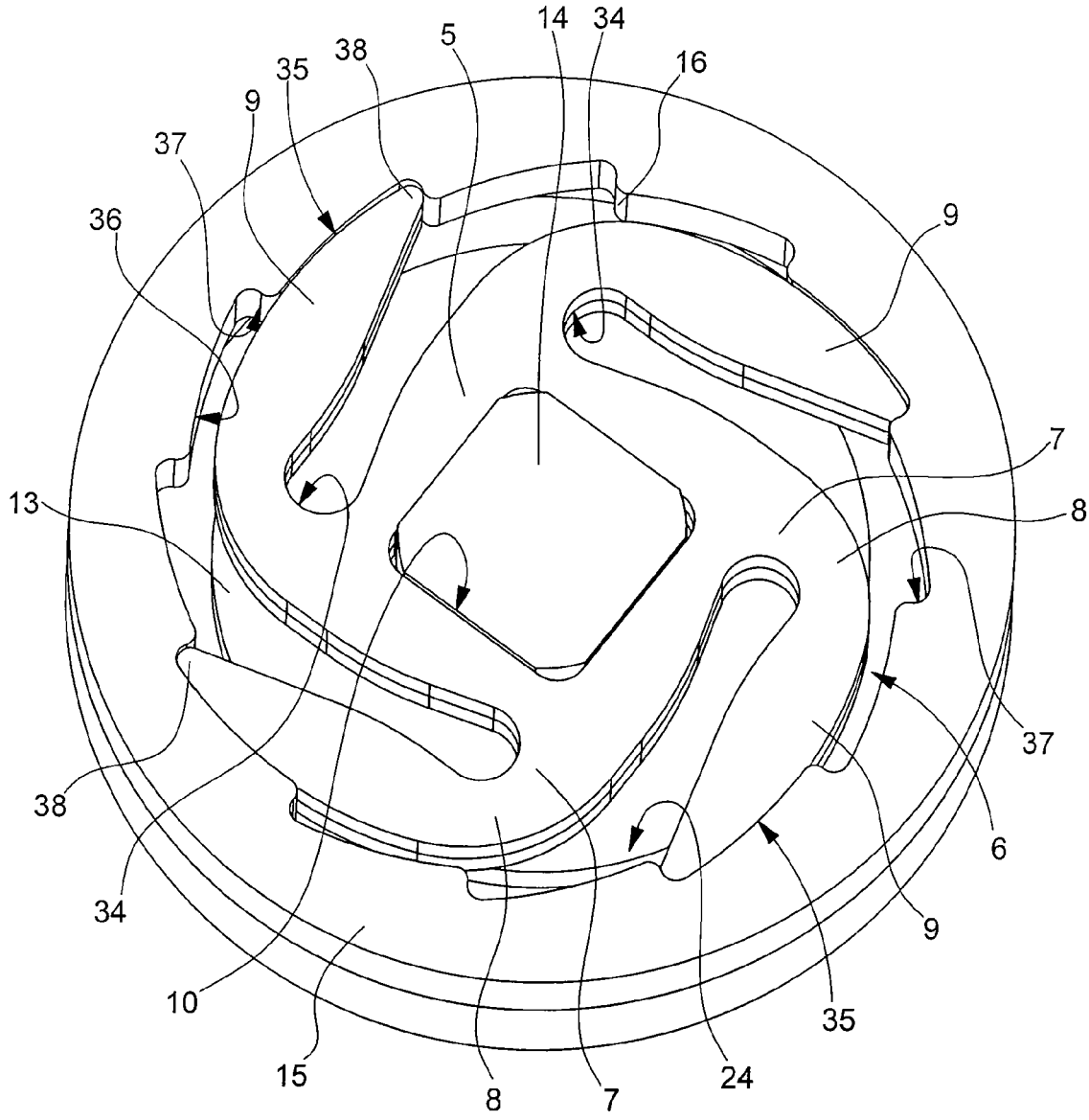
FIG. 3 shows a perspective view showing in detail the nature of the cooperation implemented between the deformable and rigid elements.

FIGS. 2 and 3 respectively show a transverse cross-section of the crown according to the present invention, the constituent elements being assembled, and a perspective view showing in detail the nature of the cooperation between the deformable and rigid elements. These Figures show more clearly the interactions existing between the various elements that have just been described in relation to the assembly thereof.

Springs 4 are obtained by a conventional manufacturing process, for example by passing under a sheet metal press. Likewise, pipe 11 for securing the winding stem is of a conventional type. Springs 4 are preferably threaded, or driven onto projecting portion 14 of the pipe, i.e. at the end of the pipe opposite the end via which the winding stem will be secured thereto. Preferably, in order to guarantee proper longevity for the device, the spring are also welded onto projecting portion 14, possibly by means of a laser beam, on a plurality of contact points located at the interface between aperture 10 of central base 5 and the contour of projecting portion 14.

It should also be noted that springs 4 are automatically centred because of their cooperation with projecting portion 14.

Moreover, ring 15 and washer 17 are also secured, preferably by laser welding, before the main portion 12 of pipe 11 is threaded through aperture 18 of washer 17. The pipe head 13 is then arranged in abutment on the flat surface 24 of washer 17, whereas the two springs 4 are arranged opposite ring 15, more specifically opposite notches 16.

The assembly thereby formed of pipe 11 carrying springs 4 with ring 15 and washer 17 are then driven inside support element 2. In a preferred but non-limiting manner, a laser weld is also applied to the interface between support element 2 and the external periphery of washer 17 in order to guarantee a better hold of the above-defined assembly over time inside the support element. It will be noted in FIG. 2 that the bottom 3 of the support element fulfils the function of a stop member during the operating in which the above-defined assembly is driven into support element 2.

As mentioned hereinbefore, the thickness of the combined springs 4 is less than the thickness of ring 15 so that the springs can rotate in relation to axis X1 without any friction against the bottom 3 of support element 2.

Support element 2 comprises a shoulder 25 facing the exterior of crown 1 and separating the inside of the support element into two portions of different internal diameters. A first portion 26 located between the bottom 3 and shoulder 25 has a first diameter substantially greater than the diameter of ring 15 and washer 17, whereas a second portion 27 extending between shoulder 25 and the end of the support element located on the side of its aperture has a second diameter greater than the first diameter.

Reducing washer 20 is then threaded into support element 2 so that it abuts against shoulder 25. Likewise, annular gasket 21 is forcibly threaded into support element 2, in abutment against reducing washer 20. If the external diameter of annular gasket 21 at rest is slightly less than the second internal diameter of support element 2, the annular gasket is slightly pre-stressed when it is in place. This measure, which is conventional, guarantees proper contact between the annular gasket and the inner wall of the support element and thus a high quality seal between these two surfaces.

The set of components thereby assembled to each other is then driven inside cover 1, the latter comprising a housing 28 of generally cylindrical shape and of slightly larger dimensions than the external dimensions of support element 2. In the regions of its aperture 29, cover 1 includes an annular groove 30 inside which flat washer 22 is arranged, a small annular shoulder 31 of smaller internal diameter than the external diameter of flat washer 22 being provided to hold it in annular groove 30. From the point of view of the manufacturing process, it should be noted that flat washer 22 is arranged against a shoulder, corresponding to the side of groove 30 facing the exterior, prior to a crimping operation performed to form shoulder 31. Moreover, the central region of flat washer 22 is then arranged in abutment against the annular gasket 21 and positions it in the direction of axis X1.

Tube 23 is then threaded inside the central space of the empty housing 28 by sliding against the annular gasket. In fact, the external diameter of tube 23 is slightly greater than the internal diameter of annular gasket 21 so as to compress the latter along a radial direction and to reinforce the seal between the annular gasket and support element 2 on top of guaranteeing the sealing between the annular gasket and tube 23. Moreover, the internal diameter of tube 23 is slightly greater than the external diameter of pipe 11 to allow the latter to rotate freely. It should be noted that during assembly of the device on a timepiece, prior to its assembly in crown 1, tube 23 is driven into the middle part of the timepiece as far as its shoulder, which is particularly visible in FIG. 2.

It will be noted in FIG. 2 that pipe 1 has been shown in partial cross-section for the sake of clarity. Indeed, it is apparent from this Figure that the pipe includes an aperture at the end thereof facing the exterior of crown 1, to arranged one end of the winding stem, as explained hereinbefore. For this purpose, pipe 11 includes a central bore 32 having a threading 33 for securing the winding stem to the pipe by being screwed therein, in a conventional manner.

FIG. 3 shows in detail the relative positioning of springs 4 with ring 15 and, more specifically, with notches 16.

The shape of springs 4 shown in the Figures corresponds to a preferred embodiment shown by way of non-limiting illustration. It is more clearly visible in FIG. 3 that the springs each have a curved shape contributing to its resilient features. In particular, it should be noted that in each of arms 6, a recess 34 is arranged partially inside the material of central base 5 and inside elbow 8, i.e. in the region that experiences the mores significant shocks at the moment the spring undergoes deformation. Recesses 34 according to this preferred embodiment have a partially circular contour.

Moreover, the second portions 9 of arms 6 have curved external surfaces in order to improve the quality of contact with ring 15 during movements of rotation. More specifically, these external surfaces comprise surface regions 35 which are in contact with long portions 36 of the inner periphery of ring 15. The long portions 36 have a substantially tangential direction in relation to axis X1 of the crown and are separated by short portions 37 forming notches 16, oriented in substantially radial directions.

The long portions 36 of the inner periphery of ring 15 have a slight curve, complementary to the curve of surface regions 35 of arms 6.

Likewise, the ends 38 of arms 6 are rounded to friction with notches 16 when the disconnecting gear device is activated.

FIG. 3 shows one part of the disconnecting gear device according to the present invention in a configuration in which it is not activated. Indeed, arms 6 of the springs are shown in the rest configuration in which they are in contact with the long portions 36 of the inner periphery of ring 15 without being deformed or only to a negligible extent.

It is clear from the diagram of FIG. 3 and from the preceding description in relation to FIGS. 1 and 2 that, when crown 1 is driven in rotation in the anti-clockwise direction, it drives ring 15 and washer 17 in the same direction. It is evident that, in this case, notches 16 exert a pressure force on the ends 38 of the spring arms with which they are meshed, consequently causing a movement of rotation of pipe 11 in the same direction and, thereby the winding stem (not shown). When the spring arms 6 experience a pressure force in this direction via their respective ends, they cannot practically be deformed, in any case while the rotational couple transmitted by ring 15 remains comprised within a range corresponding to normal use of the timepiece.

Moreover, when crown 1 is being driven in rotation in the clockwise direction, it also drives ring 15 and washer 17 in the same direction. In this case, the rotational couple is transmitted in the clockwise direction from ring 15 towards springs 4 via surface regions 35. It then appears that, from the mechanical point of view, when the resistance opposed by the winding stem, via pipe 11, reaches a certain predefined value, surface regions 35 can start to slide in relation to long portions 36 of ring 15, because of the start of deformation of spring arms 6. Thus, when the value of the couple to be transmitted to springs 4 in order for them to be driven in the clockwise direction exceeds a predefined design value, long portions 36 of the ring slide over surface regions 35 of deformed springs 4, the latter consequently no longer being driven in rotation by the rotational movement of crown 1.

As was already mentioned, this measure prevents, for example, damage to the movement of a timepiece in which the barrel spring is reloaded by rotating the crown, once the latter has reached full load. Owing to the device according to the present invention, the winding stem is no longer driven in such a case, which protects the timepiece movement.

It should be noted that an important advantage of the device according to the present invention lies in its simplicity of manufacture and assembly, in particular when one considers that the components employed have relatively small dimensions, the crown generally having a diameter of less than 5-6 millimetres.

Moreover, the structure of the device according to the present invention advantageously enables conventional winding stems to be used for setting the crown in place. Further, this structure also enables the aesthetic appearance of the crown to be very simply altered, to answer the requirements of various clients, while limiting the number of components that have to be altered in response to the diversity of such requirements. Indeed, an alteration of the external appearance of the crown is generally sufficient to obtain the desired aesthetic effect, without it being necessary to alter any of the other constituent elements of the device according to the present invention.

Furthermore, it should be noted that the embodiment described provides two identical springs 4, which allows a certain rigidity to be obtained, adapted to the desired predefined rotational couple. Those skilled in the art will be able to alter the number of springs used to adapt it to their particular requirements without departing from the scope of the present invention, by arranging more springs to increase rigidity.

As has already been mentioned, selecting materials for respectively making spring 4 and rigid ring 15 such that their corresponding hardnesses are close, guarantees better longevity for the disconnecting gear device according to the present invention. By way of example, one could use conventional types of steel, for these two elements, whose respective hardnesses are of the order of 500 to 600 HV, to find a compromise between the rigidity of the spring and wear due to friction between the two elements.

The above description corresponds to a particular embodiment and should in no way be considered limiting, as regards more specifically the shape described and shown for the spring and notches with which they cooperate.

In particular, it will easily be observed in FIG. 3 that, by turning over springs 4 and ring 15 symetrically in relation to the plane of FIG. 3, the disconnecting function is obtained for the opposite direction of rotation to that described. This particular feature gives the device according to the present invention an additional advantage due to the fact that the manufacturer can use the same components to implement the invention in one direction of rotation or the other.

Likewise, the shape described for springs 4 is not limiting and any other close shape obtaining the same technical effect could be implemented without departing from the scope of the present invention. More specifically, the number of spring arms 6 described and shown is not limiting in that it constitutes an additional parameter for adjusting the rigidity of the springs employed. In fact, because of the automatic centring originating from the cooperation of aperture 10 of the spring with projecting portion 14 of the pipe, a single arm 6 might suffice to perform the function necessary for the device according to the present invention in relation to ring 15.

Further, it is possible to provide alternative embodiments of the springs and notches 16 of ring 15, in accordance with which the behaviour of the spring is identical in both directions of rotation. In such case, one could for example provide notches in the form of small recesses made in the inner periphery of ring 15, the deformable arms of the springs then extending in substantially radial directions, in other words, they would not includes an elbow 8, to react in a similar manner to tangential forces applied to their ends, in one direction of rotation or the other.

Another variant could consist in providing two superposed stages, each of which includes a rigid ring and at least one spring cooperating with notches of the corresponding ring, the respective directions of rotation of the two stages being opposite. In this case, crown 1 could take two axial positions in relation to the winding stem, a single stage being operational in each of the two positions. This device would allow the disconnecting gear function of the present invention to be obtained in two different directions of rotation, each direction corresponding to a given axial position of the crown.

Of course, the applications of the present invention are not limited to winding stems but extend to any other use of a stem-crown liable to damage the components of the movement of a timepiece.

The invention claimed is:

1. A crown for a timepiece including a housing of axis X1 inside which are arranged in particular:

at least one first element, able to be deformed resiliently, cooperating in rotation about said axis X1, in at least a first direction of rotation, with a rigid element, as long as the rotational couple transmitted by one of said elements to the other is less than a predefined value beyond which said first deformable element is capable of being deformed to disconnect the rotational cooperation between said first element and said rigid element, wherein a pipe including, in the region of a first end, means for securing a winding stem, is disposed within the housing of axis X1 wherein said resiliently deformable element is secured to said pipe whatever the value of the rotational couple, whereas said rigid element is fixed in relation to the crown, and wherein said deformable element cooperates in rotation with the inner periphery of the rigid element of annular shape.

2. The crown according to claim 1, wherein said deformable element is a spring including a central base from which extend at least one and preferably at least two arms that can be deformed resiliently, said rigid element including a plurality of notches arranged opposite said deformable arms and for cooperating with respective surface regions of said deformable arms.

3. The crown according to claim 2, wherein each of said arms includes two successive portions, a first short portion extending from said central base along a substantially radial direction before exhibiting an elbow at substantially right angles extended by the second, substantially rectilinear, portion, carrying said corresponding surface region on at least one part of the external edge thereof.

4. The crown according to claim 3, wherein each one of said second portions of the arms has one free threaded end ending in a rounded portion.

5. The crown according to claim 4, wherein said rigid element is a ring arranged opposite said spring and the internal periphery of which includes alternating first short portions each oriented in a substantially radial direction, forming said notches, and second portions longer than said first portions and each oriented in a substantially tangential direction in relation to said axis X1, said second portions being capable of cooperating with said surface regions of the arms.

6. The crown according to claim 5, wherein, in a direction of rotation corresponding to the direction of inclination of said elbow in relation to the direction of said corresponding first portion, said free ends of the arms cooperate with said notches such that a movement of rotation of said rigid element causes a movement of rotation of said spring in the same direction, whatever the value of the transmitted rotational couple.

7. The crown according to claim 2, wherein said spring is arranged in the region of the second end of said pipe opposite to said first end.

8. The crown according to claim 7, wherein said pipe has, at said second end, a projecting portion substantially aligned with said axis X1 and whose periphery has a non-circular shape, said central base of said spring having a hole substantially aligned with said axis X1 and whose shape is adapted to cooperate with said projecting portion in a movement of rotation.

9. The crown according to claim 8, wherein said periphery of said projecting portion has a polygonal shape, preferably a square shape.

10. The crown according to claim 5, wherein there is provided a support element secured inside said housing of the crown and of substantially complementary shape to the shape of the latter, said deformable and rigid elements and said pipe being arranged inside said support element.

11. The crown according to claim 10, wherein said rigid element is secured to said support element, whereas said pipe includes a tube and a head of substantially flat annular shape, whose diameter is greater than the diameter of said tube, and arranged in the region of said second end of the pipe, an additional annular element being secured to said support element abutting against said head of the pipe to hold the latter along the direction of axis X1 while allowing a relative movement of rotation of said two elements in relation to axis X1.

12. The crown according to claim 1, wherein said rigid element is made of a metal or ceramic material.

13. The crown according to claim 12, wherein said deformable and rigid elements have respective hardnesses of similar values.

14. The crown according to claim 1, wherein a plurality of identical deformable elements are stacked so as to cooperate with said rigid element in order to increase said predefined rotational couple value.

15. The crown according to claim 8, wherein said projecting portion has a thickness at least equal to double the thickness of said deformable element, a second stage including additional deformable and rigid elements being arranged in superposition in relation to the first stage in the opposite direction, i.e. to have a similar function to the function of said first stage in the opposite direction of rotation, the crown having at least two axial positions in relation to said winding stem, said first stage operating in a first axial position of the crown whereas said second stage operates in the second axial position.

16. A timepiece including the crown according to claim 1.

* * * * *